US006192540B1

(12) United States Patent
Tsung-Ping

(10) Patent No.: US 6,192,540 B1
(45) Date of Patent: Feb. 27, 2001

(54) WOMAN'S SHOE INSERT

(76) Inventor: Chen Tsung-Ping, No. 41, Lane 65, Alley 200, Section 4 Kuang Fu Road, Feng Tien Village Tien Wei Hsiang, Chang Hua Hsien (TW)

( * ) Notice: Subject to any disclaimer, the term of this patent is extended or adjusted under 35 U.S.C. 154(b) by 0 days.

(21) Appl. No.: 09/395,276

(22) Filed: Sep. 13, 1999

(51) Int. Cl.[7] ..... A43D 3/00
(52) U.S. Cl. ..... 12/128 R; 12/128 B; 12/114.2
(58) Field of Search ..... 12/128 R, 128 H, 12/128 B, 114.2, 115.2

(56) References Cited

U.S. PATENT DOCUMENTS 896,536 * 8/1908 Hayden ..... 12/128 B
1,990,679 * 2/1935 Ventola ..... 12/115.2
2,446,904 * 8/1948 Brush ..... 12/128 B
4,718,135 * 1/1988 Colvin ..... 12/114.2

* cited by examiner

*Primary Examiner*—Paul T. Sewell
(74) *Attorney, Agent, or Firm*—Harrison & Egbert

(57) ABSTRACT

The construction shape of a womans's shoe insert is similar to the inner portion of a shoe. An angled surface is formed at a rear end of the shoe insert which extends to a seat of a bottom end thereof. The angled surface has a locating trough which is broad on the top end. The locating trough and narrow on the bottom end engageable with a front end of a support rod, which uses the rear end of the support rod to support the rear end of the shoe.

4 Claims, 5 Drawing Sheets

WOMAN'S SHOE INSERT

FIELD OF THE INVENTION

The present invention relates generally to a shoe insert, and more particularly to the shoe insert that is used inside a woman's shoe to support the surface of the shoe.

BACKGROUND OF THE INVENTION

A shoe insert is usually inserted at the front tip of the shoe to support the inner portion of the shoe, so as to make the shoe's surface straight and upright. Therefore, a shoe insert is a very important part to use inside the shoe, and that manufacturers would like more efforts in improving the shoe insert shapes or materials.

There are various shapes and materials of the shoe insert that can be found on the market. Among those materials are polymeric materials, bubble-wrap material and paperboard material. However, the structure of those materials can be divided into paper material and plastic or bubble plate-shaped. Such structure is defective in design as described hereinafter.

1. The paper ball-shaped shoe insert is taken from a waste paper. Such structure is defective because the support in the shoe is not strong.
2. The plastic plate-shaped shoe insert is rather tough, but it can not be decomposed naturally and that will cause an environmental problem.
3. The bubble plate-shaped shoe insert is light, but it also can not provide durable supports in the shoe and can not overcome the environmental problem.

SUMMARY OF THE INVENTION

The primary objective of the present invention is to provide an improved woman's shoe insert which is free from the shortcomings of the conventional shoe insert described above.

The structure of the present invention comprises an angled surface which is formed at a rear end of the shoe insert from the top and by extending to a seat extending outwardly of the angled surface at a bottom of the insert. The angled surface is approximately centrally located by using a trough locating extending from a top of the seat. The locating trough is broad on the top and narrow on the bottom and is engageable with a front end of a support rod. The rear end of the support rod supports the rear end of the shoe.

Such design of the present invention is cost-effective because it is made from high fiber content recycled waste paper.

The features, functions, and advantages of the present invention will be readily understood upon a thoughtful deliberation of the following detailed description of the embodiments of the present invention with reference to the accompanying drawings.

DETAILED DESCRIPTION OF THE EMBODIMENT

Figure 1:
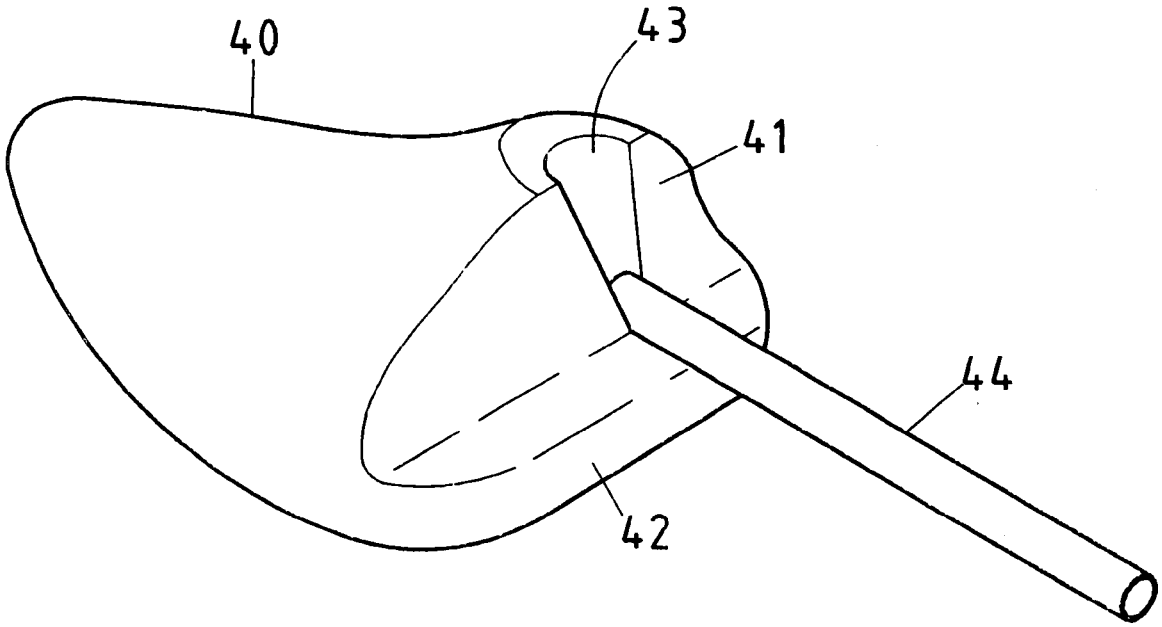
FIG. 1 shows a perspective view of the preferred embodiment of the present invention.
Figure 2:
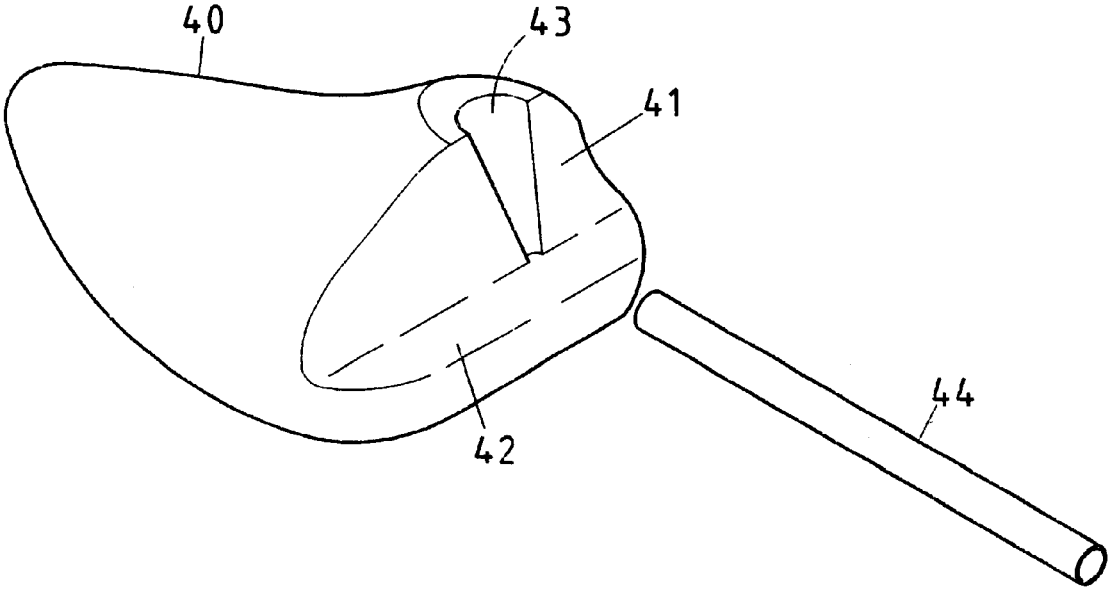
FIG. 2 shows an exploded view of the preferred embodiment of the present invention.
Figure 3:
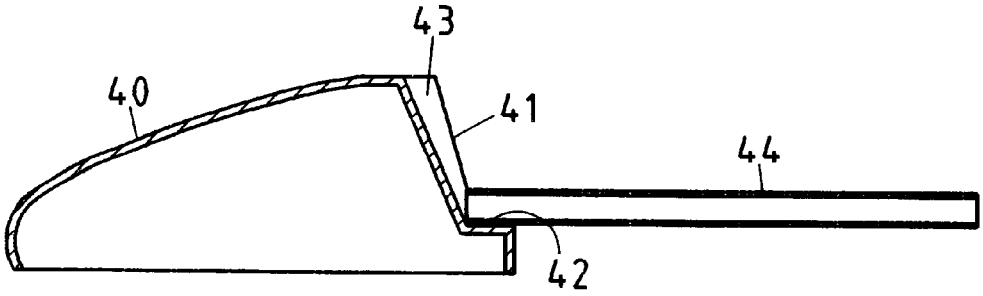
FIG. 3 shows a side sectional view of the preferred embodiment of the present invention.
Figure 4:
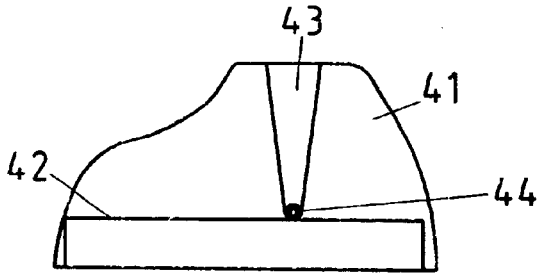
FIG. 4 shows a longitudinal sectional view of the preferred embodiment of the present invention.
Figure 5:
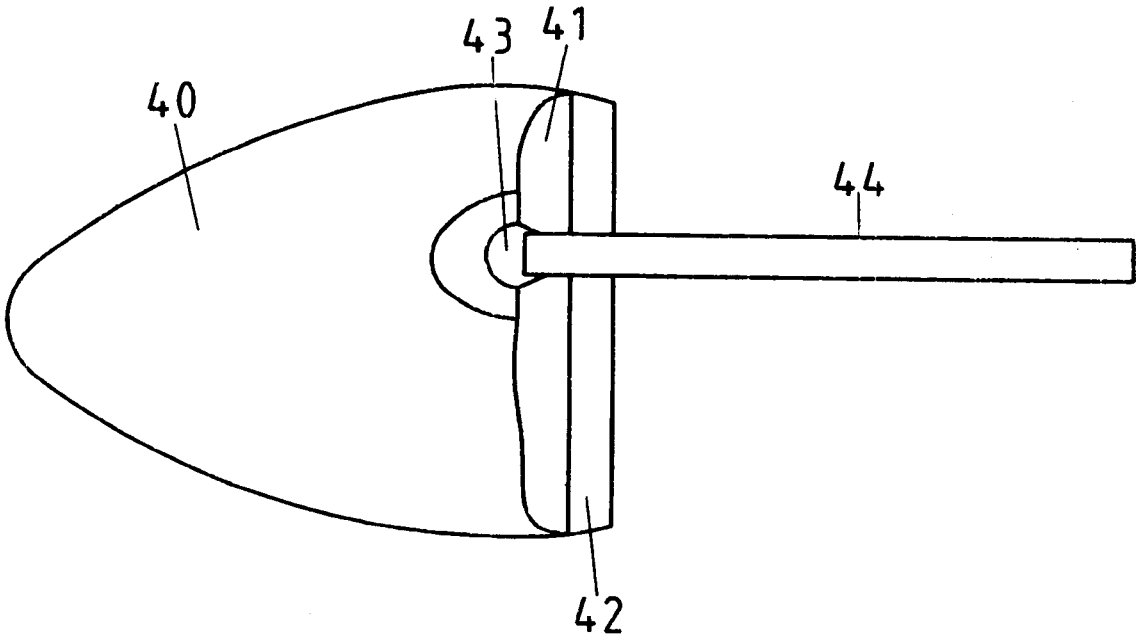
FIG. 5 shows a plan schematic view from the top portion of the preferred embodiment of the present invention.

As shown in FIGS. 1–3, woman's shoe insert 40 is a hollow construction and its shape is similar as the toe portion inside the shoe. An angled surface 41 is formed at a rear end of the shoe insert 40, extending from the top end to the bottom end at the top surface of seat 42. The angled surface 41 is provided centrally with a locating trough 43 on the top end of the seat 42. The locating trough 43 is broad on the top and narrow on the bottom and so as to be with a front end of a support rod 44. The support rod 44 is a hollow construction. The front end of the support rod 44 inserts into the locating trough 43 at the rear end of the shoe insert 40, and the rear end of the support rod 44 supports the rear end of the shoe 50. The seat 42 has a top planar horizontal surface. The hollow interior of the shoe insert 40 opens at the bottom thereof. The seat 42 extends outwardly of the angled surface 41.

Figure 6:
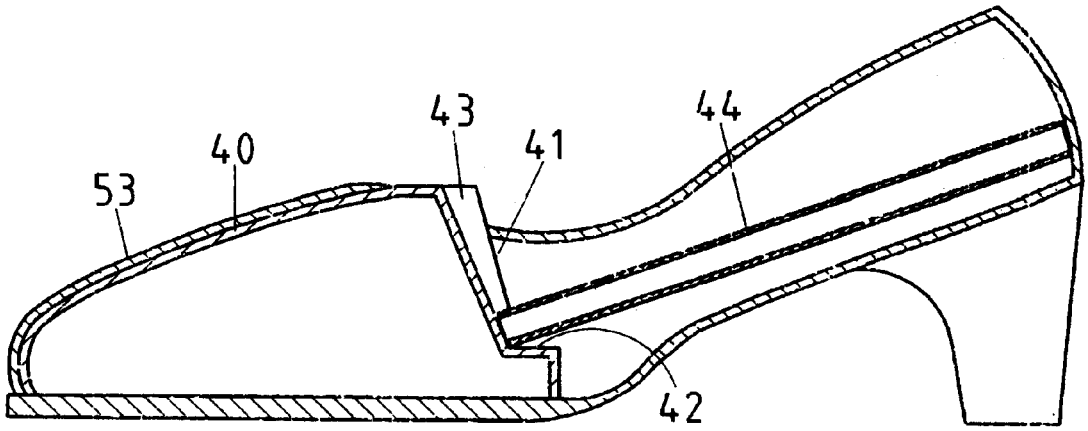
FIG. 6 shows a sectional schematic view of the preferred embodiment of the present invention in retaining at the inner portion of the shoe.

When the present invention is in use (as shown in FIG. 6), the shoe insert 40 as described above is inserted into the inner portion of the shoe 50. The structure of the shoe insert 40 is shaped to match the shape of the inner surface of the toe of the shoe 50. It therefore provides support to the surface 53 of the shoe 50 with straight and upright support. Moreover, one end of the support rod 44 supports the rear end of the shoe 50 preventing the shoe 50 from deforming.

It is a feature of the present invention wherein the shoe insert 40 and said support rod 44 can remove moisture when the shoe 50 is wet, and that said shoe insert 40 and said support rod 44 can be used again after air drying or sun drying.

It is another feature of the present invention wherein the shoe insert 40 and the support rod 44 can have a fragrance and anti-bacterium to rid mildew and foul smells. Thus, the inner portion of the woman's shoe 50 smells sweet and prevents bacteria from breeding.

It is still another feature of the present invention wherein said shoe insert 40 and the support rod 44 are molded from the liquid of recycled waste paper. Such structure is stronger than the structure of the prior art devices, and more efficient in moisture absorption. The present invention can be recycled after use so that it will not effect the environment.

The embodiment of the present invention described above is to be regarded in all respects as being merely illustrative and not restrictive. Accordingly, the present invention may be embodied in other specific forms without deviating from the spirit thereof . The present invention is therefore to be limited only by the scopes of the following appended claims.

What is claimed is:

1. A device comprising:

a shoe having a toe portion and a heel portion;

a body having a shape matching an interior shape of said toe portion of said shoe, said body having an angled surface formed at a rear end thereof, said body having a seat extending outwardly from said rear end, said seat having a horizontal planar top surface, said angled surface extending from a top of said body to said top surface of said seat, said angled surface having a trough extending centrally thereof from said top to said top surface of said seat, said trough tapering so as to be wide at said top of said body and narrow at said top surface of said seat; and a rod having a forward end engaged in said trough adjacent said top surface of said seat, said rod extending outwardly from said rear end of said body, said rod having a rearward end abutting an inner surface of said heel portion of said shoe.

2. The device of claim 1, said rod being hollow, said rod being slidably inserted into said trough.

3. The device of claim 1, said body and said rod having a fragrance and an antibacterial incorporated therein.

4. The device of claim 1, said body and said rod being formed entirely of a recycled waste paper material.

* * * * *